US005820428A

United States Patent [19]

Stadler

[11] Patent Number: 5,820,428

[45] Date of Patent: Oct. 13, 1998

[54] LEVER ACTION SWIM FIN

[76] Inventor: Donald E. Stadler, 1249 Hollywood Ave., Jacksonville, Fla. 32205

[21] Appl. No.: 18,483

[22] Filed: Feb. 4, 1998

[51] Int. Cl.[6] ..... A63B 31/08

[52] U.S. Cl. ..... 441/64

[58] Field of Search ..... 441/61–64

[56] References Cited

U.S. PATENT DOCUMENTS

| | | | |
|---|---|---|---|
| 3,978,537 | 9/1976 | Shamlian | 441/64 |
| 4,773,885 | 9/1988 | Ciccotelli | 441/64 |
| 4,869,696 | 9/1989 | Ciccotelli | 441/64 |

*Primary Examiner*—Jesus D. Sotelo
*Attorney, Agent, or Firm*—Thomas C. Saitta

[57] ABSTRACT

A swim fin which automatically locks into a rigid configuration when pressure is exerted against the blade during the propulsion stroke, transferring the forces and stresses past the foot to the ankle area and lower leg of the wearer, the fin having a pair of rigid brace members extending from the rear of the blade portion, with the free ends of the brace members connected to an ankle harness by a rod and slot combination and with the brace members pivotally connected to a rigid fulcrum positioned at or near the front of the foot. The slots in the brace members are offset approximately 20 to 25 degrees from the longitudinal axis of the brace members. When little or no pressure is applied to the blade, the brace members and blade can move relative to the ankle harness, but when pressure is applied to the blade, such as during the propulsion stroke, the brace members pivot on the fulcrum, automatically locking the free ends of the brace members to the ankle harness.

17 Claims, 5 Drawing Sheets

LEVER ACTION SWIM FIN

BACKGROUND OF THE INVENTION

This invention relates generally to the field of swim fins worn on the feet of swimmers, snorkelers or scuba divers to increase propulsion by providing an enlarged surface area to push against the water. More particularly, the invention relates to such swim fins which transfer forces encountered during propulsion from the feet to the ankles and legs of the wearer. Even more particularly, the invention relates to such swim fins where a leveraging action can rigidify the structural members during the propulsion strokes to fix the swim fin in relation to the foot, ankle and leg, but where the structural members allow for foot and ankle rotation and flexation at other times.

A swim fin in general comprises a relatively broad and extended, generally flat, fin-like member which is attached to the foot of the swimmer. The fin is generally attached in one of two ways, either by a heel-less foot pocket with open or closed toes which receives the front portion of the foot and has a strap which encircles the heel, or by a full foot pocket having a built in heel portion similar in appearance to a slipper or shoe. Non-typical or exotic designs may include a full boot which encloses the ankle area as well as the foot. The fin or blade portion extends outwardly from the toes and is usually formed of a somewhat flexible material, such as rubber or a synthetic polymer, with reinforcing members positioned to reduce the inherent flexibility if necessary and channel water behind the fin. The reinforcing members are typically perpendicular flanges running along each lateral edge of the blade and/or longitudinally extending ridges on the blade upper or lower surfaces. The purpose of the swim fin is to increase speed and provide more power for the swimmer. Material selection, blade size, shape and stiffness, venting or channeling mechanisms, and various structural or mechanical features have been developed to address these needs and others, such as smoother performance, better control and reduction of stress to the foot and ankle.

A basic problem with the common swim fin design is that during the kicking stroke, the resistance encountered by the swim blade as it is pushed through the water is directly transferred to the front of the foot, which puts stress and strain onto the ball and arch area of the foot and onto the ankle area. The muscles and muscle groups, used to counter this stress are relatively weak, especially in the planar flexation direction of the foot. This can lead to fatigue, pain and even stress-related injuries to the foot or ankle.

In attempting to solve this problem, swim fins have been developed which transfer the stresses from the forward part of the foot directly to the ankle or lower leg of the wearer, where larger, stronger muscle groups are present. The earliest attempts are characterized by the provision of means to lock the blade to the ankle or lower leg by rigid, fixed structural members, such as by providing a rigid boot or by utilizing struts or braces to connect the blade or fin portion to the leg. Examples of this approach can be seen in U.S. Pat. Nos. 3,978,537 and 4,017,925 to Shamlian. A major drawback to such designs is that the angle between the swim fin and the leg is fixed or partially fixed, meaning that there can be no or only very limited foot flexation unless the device or the bracing members of the device are removed or released. Thus the wearer's ability to make fine adjustments to position or direction when swimming in the water is restricted. Another drawback to this type of device is that there is no provision made to allow for foot or ankle rotation, and in fact most designs specifically try to restrict any rotational ankle or foot movement, which is seen as a mechanism for power loss during the propulsion stroke. While it is true that during the power stroke ankle and foot rotation is usually detrimental, there are circumstances during use where the ability to rotate the fin by rotating the foot or ankle is desirable, such as performing different types of kicks, such as a frog kick, correcting diver trim, reversing and stopping.

It is an object of this invention to provide a swim fin which maintains or increases the efficiency and effectiveness of the power or propulsion stroke while reducing stress on the foot and ankle, by providing a lever-type mechanism to transfer the forces encountered by the swim fin blade directly to the ankle area and lower leg of the wearer. It is a further object to provide such a device which allows the wearer relatively unrestricted ankle and foot flexation and rotation except during the power propulsion stroke, at which time the angle between the fin and the leg remains relatively fixed and rotational movement is also restricted. These and additional objects apparent in the later description are accomplished by providing a swim fin with an extended blade portion having a pair of longitudinally extending, spaced, brace members or arms, where the ends of the brace members are connected to an ankle or lower leg encircling member in a manner which allows for foot flexation and rotation, and where the brace members are pivotally mounted to fulcrum members adjacent the front of the foot, such that flexation and rotation area automatically severely restricted or precluded when sufficient force is exerted against the fin blade, such as would be encountered when the fin is moved through the water in the standard reciprocating propulsion stroke.

SUMMARY OF THE INVENTION

The invention is in general a swim fin worn on the feet of a swimmer, snorkeler or scuba diver which decreases stress on the foot and ankle resulting from movement of the fin through the water in a reciprocating kicking manner, thereby allowing the user to swim with less exertion and discomfort. The swim fin comprises a blade or fin portion which is generally flat or slightly curved, usually reinforced to preclude excessive bending, attached to a pair of generally parallel brace or arm members extending longitudinally from the back of the fin. The brace members are separated a sufficient distance laterally so as to pass on either side of a foot. The fin and brace members are connected to the user at two positions—the first near the ball or front of the foot and the second at the ankle area or lower leg area. The swim fin further comprises foot harnessing means and ankle harnessing means to receive the brace members and attach the device to the user's foot and ankle area or lower leg. The foot harnessing means may comprise a full boot, a heel-less boot or strap members connected to a base plate. The ankle harnessing means may comprise a part of the full boot or may be a cuff member which encircles the ankle or lower leg. The two brace members are attached to fulcrum means mounted on or attached to the foot harness in the vicinity of the ball or front part of the foot, in a manner which creates a rigid support upon which the brace members and fin pivot relative to the foot harness. The free ends of the brace members are connected to the ankle harness by mechanical fasteners extending from receptacles mounted on the boot or cuff and through rotation slots near the ends of the brace members. The slots are linear or slightly curved, and are positioned at an angle preferably approximately 20 to 25 degrees off the line extending from the midpoint of the slot to the fulcrum means. When there is little or no pressure exerted against the fin blade, the ankle and ankle harness may be rotated and flexed by the user relative to the brace members, allowing the foot and fin to be moved side to side or flexed up and down relative to the ankle and leg. But when sufficient pressure is exerted against the blade during the kicking stroke, the brace members pivot about the fulcrum means and this lever action presses the sides of the slots in the ends of the brace members against the mechanical fasteners connecting the brace members to the ankle harness. The force is sufficient to automatically lock the brace members to the ankle harness to prevent or severely restrict relative movement and rotation between the ankle harness and the fin brace members, and provides for direct transfer of forces encountered by the blade to the ankle and lower leg of the user, thus relieving stress to the foot by creating a relatively rigid assembly which acts as an extension of the user's leg.

DETAILED DESCRIPTION OF THE INVENTION

With reference to the drawings, the invention will now be described in detail with regard for the best mode and the preferred embodiments. In its most general form, the invention comprises a swim fin for a scuba diver, snorkeler or swimmer which provides increased propulsion from the kicking stroke while simultaneously reducing stresses to the front and arch of the foot resulting from the reciprocation of the fin through the water. Forces and stresses are passed through to the ankle and lower leg of the user by a pair of spaced, rigid brace members 12 extending longitudinally from the rear of the fin blade 10, the brace members 12 attached at or near the forward part of the foot in a pivoting manner and with the free ends 14 attached to the ankle area or lower leg, and most preferably directly on the ankle itself, where the brace members 12 become rigidly fixed relative to the ankle in a non-moving manner when sufficient pressure is exerted against the fin blade 10, as would be encountered in a normal swimming kick, but where the brace members 12 are movable relative to the ankle when little or no pressure is applied to the fin blade 10, thereby allowing for rotation and flexation of the fin and foot relative to the ankle.

Figure 1:
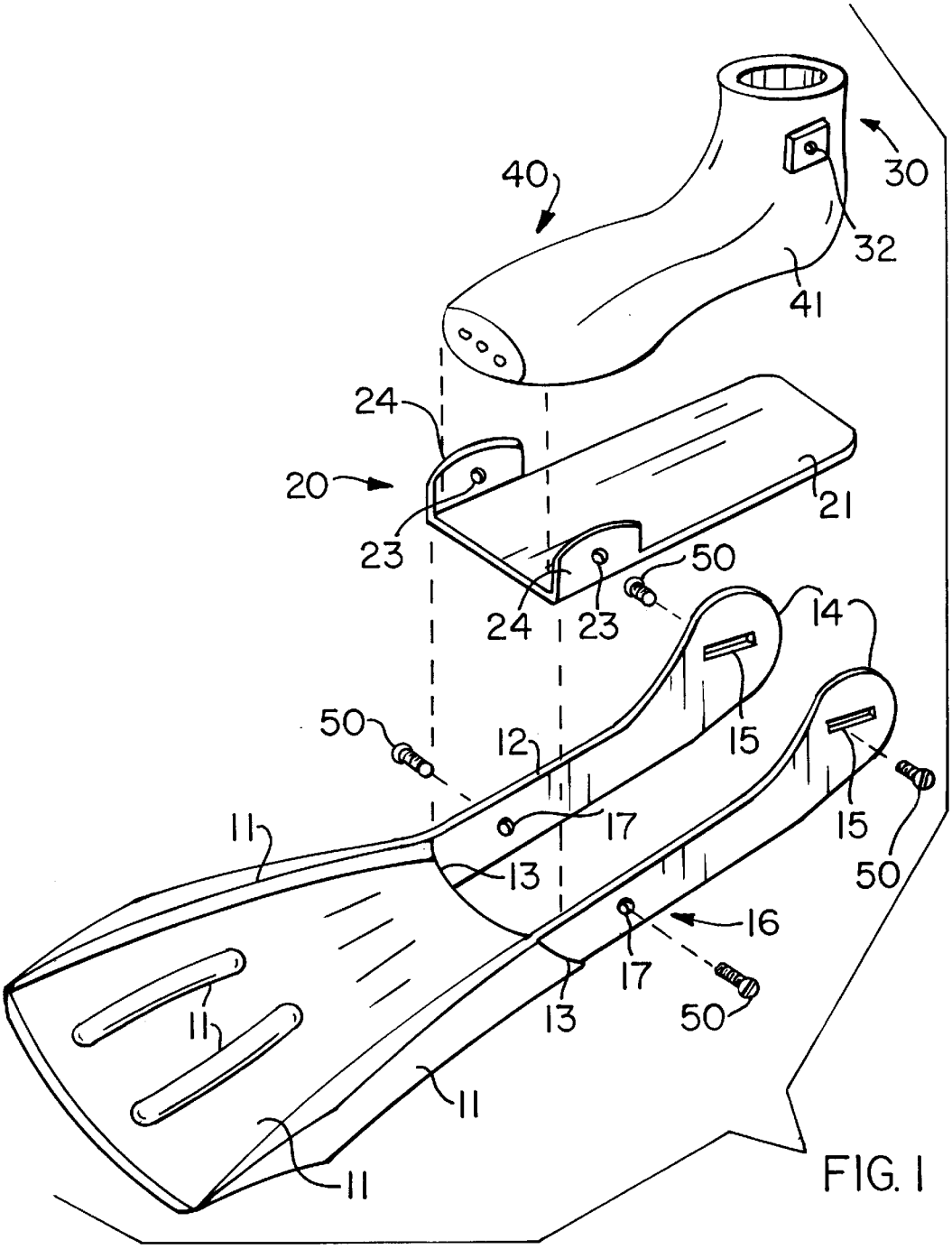
FIG. 1 is an exploded perspective view of one embodiment of the invention.
Figure 2:
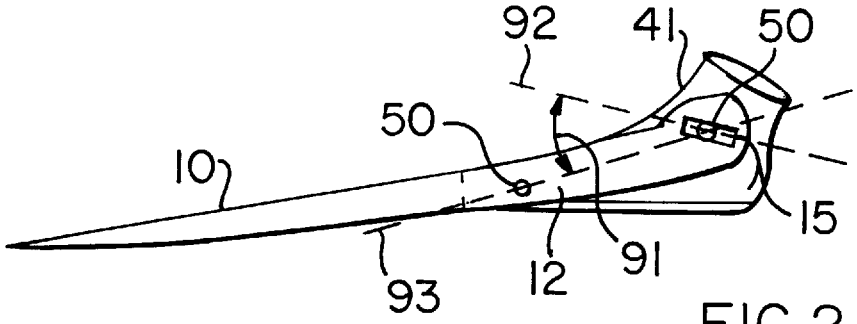
FIG. 2 is a side view of the embodiment of FIG. 1.
Figure 3:
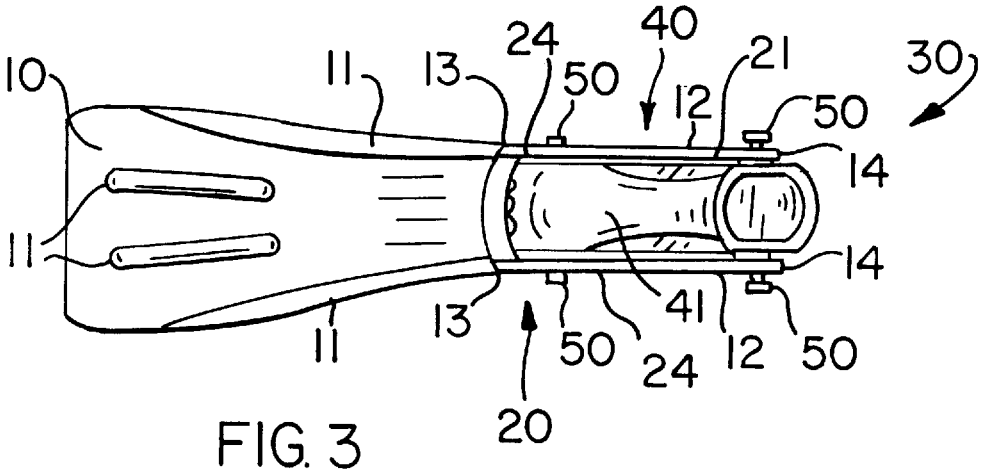
FIG. 3 is a top view of the embodiment of FIG. 1.

FIGS. 1 through 3 illustrate a primary embodiment of the invention. The swim fin comprises generally a blade or fin portion 10, a pair of brace or arm members 12, fulcrum means 20, ankle harnessing means 30, which is defined herein to include means to harness the device to the ankle area or lower leg, and foot harnessing means 40. The blade 10 may be of any suitable shape or configuration found in swim fin propulsion devices, and typically will be of a generally planar or slightly curved overall configuration, relatively thin in cross-section compared to its length and width, and possibly containing reinforcing members 11 positioned along the lateral edges or at spaced locations across the main body, the reinforcing members 11 forming generally T-shaped edges or raised segments on the body interior and designed to reduce flexibility in the region nearest the foot and to influence water flow direction. The fin blade 10 may be formed of a flexible or relatively rigid rubber or polymer material. The wide upper and lower surfaces of the blade 10 increase the surface area encountering the water as the user kicks through the water to raise and lower the blade 10 in a reciprocating manner. Extending from the rear of the blade 10 are two brace or arm members 12, each having a fixed end 13 and free end 14. The brace members 12 are rigid, especially in the vertical direction, such that the braces 12 cannot be flexed vertically. Some flexation in the lateral direction may be allowed. The brace members 12 may be composed of a suitably rigid material such as a metal, an inherently rigid polymer, or reinforced flexible polymer or rubber. The braces 12 extend longitudinally from the rear of the blade 10, preferably in the same or substantially parallel to the plane of the blade 10, and are spaced from each other a sufficient distance, approximately 3.5 to 5.5 inches, to allow placement therebetween of an adult foot, unclad or covered by a diver's booty. Thus the combination of the rear or back end of the blade 10 and the two brace members 12 form a general U-shape when seen from above or below.

Figure 4:
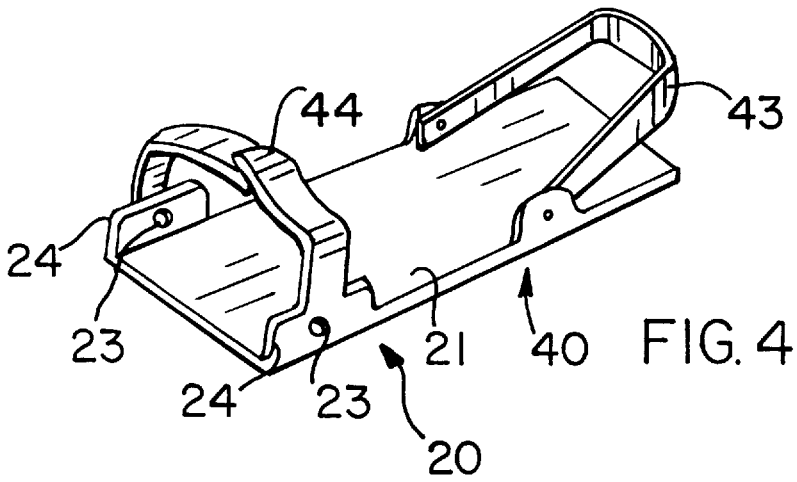
FIG. 4 is a perspective view of an alternative embodiment of the base plate and foot harnessing means.
Figure 5:
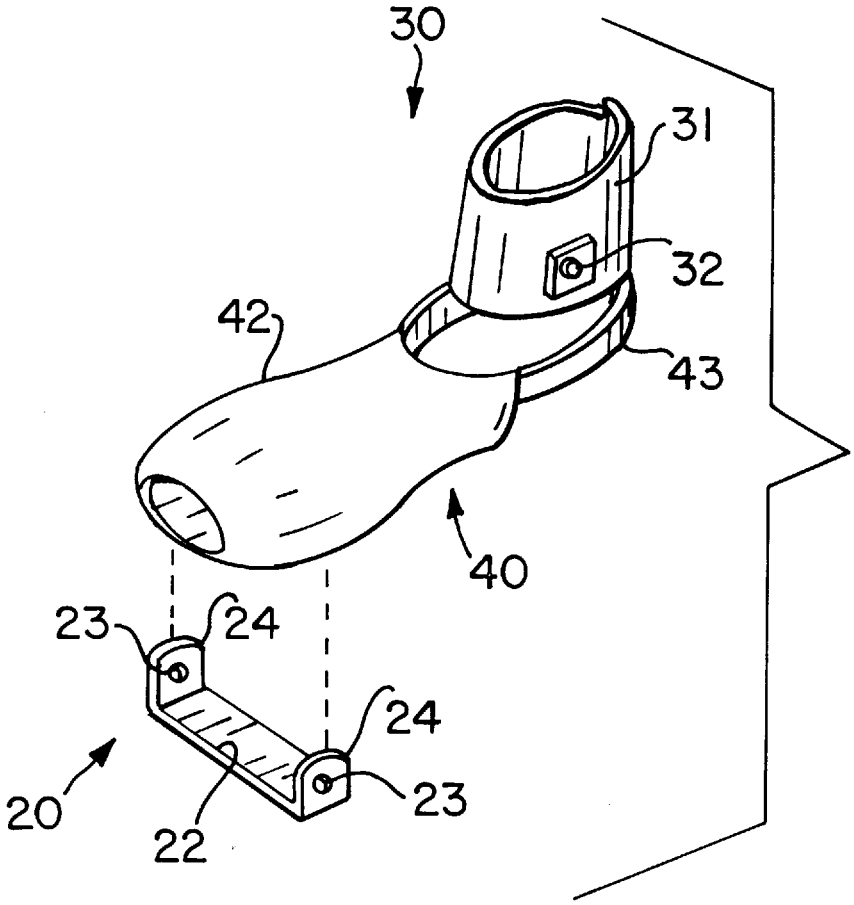
FIG. 5 is an exploded perspective view of an alternative embodiment for the base plate, ankle harnessing means and foot harnessing means.

Each brace member 12 comprises a pivot means 16, such as an aperture 17 or other means to pivotally connect the brace 12 to a fulcrum means 20, and a rotation slot 15 to connect the brace 12 to an ankle harnessing means 30. The pivot aperture 17 is positioned in the forward portion of the brace member 12, at or near the fixed end 13 joining the brace 12 to the blade 10, such that the pivot aperture 17 will be situated at or near the ball or front of the foot when the device is worn. In the embodiment pictured, the pivot aperture 17 is a circular opening extending laterally through the brace member 12 sized to receive a mechanical fastener 50, such as a rod, bolt or pin circular in cross-section. The fulcrum means 20 is any suitable construction which provides a rigid structure in the lateral direction between the two brace members 12 so as to create a fulcrum or pivot point for movement of the brace members 12. As shown in FIGS. 1 and 4, the fulcrum means 20 preferably comprises a rigid base plate 21 sized to receive all or a major portion of the sole of a foot, the base plate 21 composed of a suitably rigid metal or polymer and having a pair of opposing threaded receptacles 23 mounted in flanges 24 extending generally perpendicularly upward from the base plate 21. The threaded receptacles 23 receive the mechanical fasteners 50 inserted through the pivot apertures 17, thus connecting the brace members 12 to the base plate 21 in a pivoting manner. Alternative fastening systems for connecting the brace members 12 to the fulcrum means 20 in a pivoting manner may be suitably interchanged without departing from the scope of the invention, such as rods or pins 50 fixed to the flanges 23, or rods or pins 50 fixed to the brace members 12 and extending into the receptacles 23.

At or near each the free ends 14 of the brace members 12 is a thin, elongated, rotation slot 15, preferably about 1 to 2 inches in length and roughly ⅛ to ⅜ inches in width, which passes through the body of the brace members 12. The slot 15 is preferably linear or slightly curved and is angled upward in the forward direction toward the blade 10 relative to the brace member 12. The angle 91 formed between the slot line 92 passing through the longitudinal dimension of the slot 15 and the lever line 93 passing longitudinally through the pivot aperture 17 and generally parallel to the brace member 12 and the blade 10, and preferably passing through the approximate midpoint of the slot 15, is preferably in the range of approximately 10 to 35 degrees and most preferably approximately 20 to 25 degrees. The rotation slot 15 in combination with a rod, pin, bolt or other mechanical fastener 50 forms the means to connect the free ends 14 of the brace members 12 to the ankle harnessing means 30 in a manner allowing some relative movement between the brace members 12 and the ankle harnessing means 30.

As shown in FIGS. 1 through 3, the foot harnessing means 40 and the ankle harnessing means 30 may be comprised of a single boot-like member 41 which receives the foot and ankle of the wearer in a generally snug manner. The boot 41 is preferably composed of a somewhat flexible rubber or polymer material, including neoprene or the like, and may have an open or closed toe. The boot 41 is attached to the base plate 21, preferably permanently through adhesives, but could also be connected by mechanical fasteners, straps or the like, either permanently or removably. The foot harnessing means 40 is the means to retain the foot securely within the device. The ankle harnessing means 30 is the means to retain the ankle area or lower leg within the device and the means to connect the brace members 12 to the ankle harness 30. The ankle harness 30 comprises receptacle members 32, preferably threaded to receive a threaded mechanical fastener or bolt 50 which is inserted through the rotation slot 15 in the brace member 12. The mechanical fastener 50 and slot 15 are sized such that the brace member 12 can move relative to the mechanical fastener 50 and ankle harness 30. Other suitable means to join the brace members 12 to the ankle harness 30 in a manner which allows relative movement over the range defined by the rotation slot 15, such as fixing rods 50 to either side of the ankle harness 30, may be substituted for the particular combination of elements set out without departing from the spirit of the invention.

Figure 8:
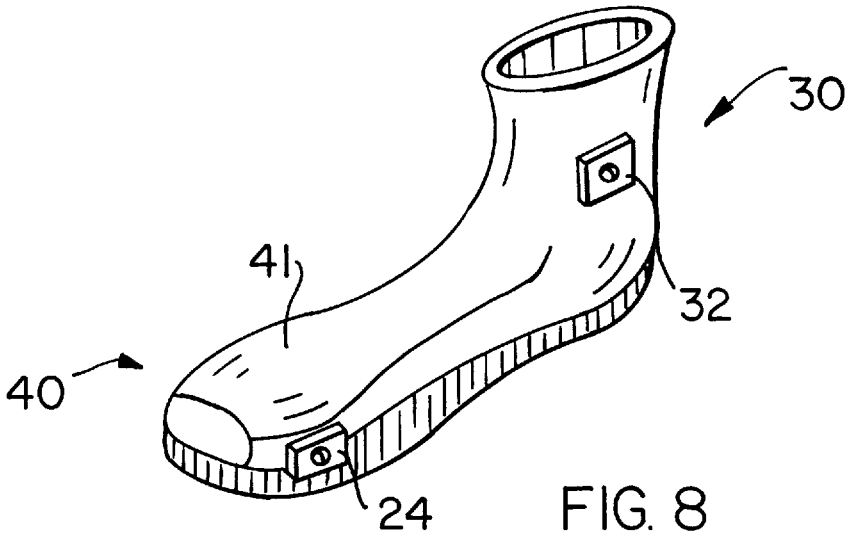
FIG. 8 is a perspective view of an alternative embodiment of the foot and ankle harnessing means, comprising a full boot.
Figure 9:
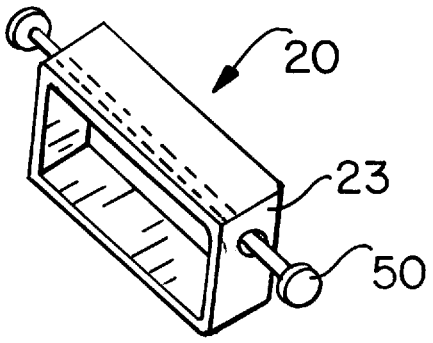
FIG. 9 is a perspective view of an alternative fulcrum means.

Alternative embodiments for the fulcrum means 20, foot harness 40 and ankle harness 30 are shown in FIGS. 4, 5, 8 and 9. The boot 41 may be replaced by either a base plate 21 with a foot strap 44 positioned to encircle the front of the foot and a heel strap 43 positioned to encircle the heel, the foot and heel straps 44 and 43 composed of any suitable material such as fabric, webbing, polymer, rubber, neoprene or the like and releasably connected by a buckle, hook and loop fastener or the like, or the boot 41 may be replaced by a heel-less boot 42 which completely encircles the main forward portion of the foot but utilizes a heel strap 43 to encircle the heel. The boot 41 or heel-less boot 42 can be mated with a fulcrum means 20 comprising a foot bracket 22, a generally C-shaped rigid member made of metal or rigid plastic having two opposing flanges 24 which cradle the ball of the foot (FIG. 5), each flange 24 having a threaded receptacle 23 to receive the mechanical fastener 50 to pivotally connect the brace members 12, or a rectangular rigid member made of metal or rigid plastic through which the foot is inserted (FIG. 9), where the mechanical fastener 50 may comprise a rod or pin passing completely through the foot bracket 22 and above the inserted foot. The foot bracket 22 is preferably permanently attached to the foot harnessing means 40 by adhesive or suitable mechanical fastening means. Both of these embodiments require a separate ankle harness 30, shown in FIG. 5, which may comprise a cuff 31, preferably of a wrap-around type with hook and loop fasteners or the like for closure and sizing. The cuff 31 contains the threaded receptacles 32 to receive the mechanical fasteners 50 to connect the brace members 12 through the ankle rotation slots 15. In another alternative embodiment, rather than being externally attached, the fulcrum means 20 may be built into the foot harness 40, and the threaded receptacles 32 may be built into the ankle harness 30. Still another alternative construction for the boot 41 is shown in FIG. 8, where the receptacle members 32 and/or flanges 24 are mounted directly onto or built into the sides of the boot 41. In this instance the boot 41 must be reinforced in the front or forward area to provide a sufficiently stable fulcrum when pressure is exerted against the fin blade 10.

Figure 7:
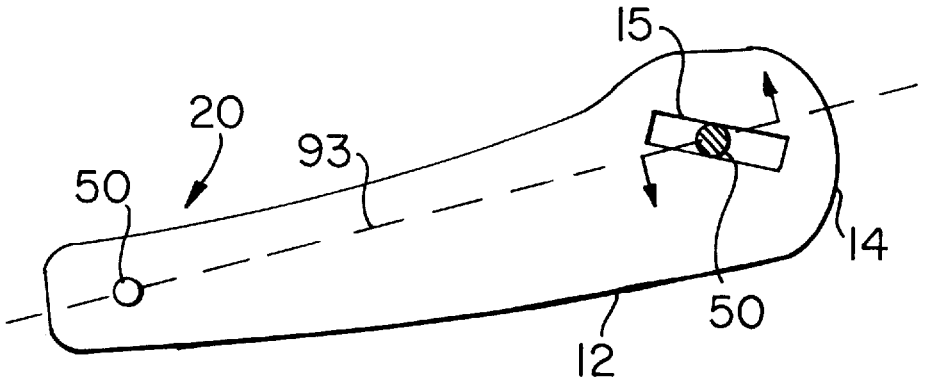
FIG. 7 is a partial view of a brace member, showing the forces exerted against the slot side walls during the leveraging action.

During active use, when the wearer is using the kicking stroke to provide forward propulsion, the structure as described automatically locks when a minimum locking threshold is exceeded to create a rigid swim fin which transfers stress and pressure produced by reciprocal movement of the fin blade 10 through the water directly onto the ankle or lower leg of the wearer, as opposed to conventional swim fins which direct the stresses and forces onto the foot. The fulcrum means 20 provides the rigid support on which the blade 10 and brace members 12 pivot. The blade 10 and brace members 12 combine to form a lever pivoting on the mechanical fastener bolt or pin 50 mounted in fulcrum means 20. The forces exerted against the blade 10 by passage through the water leverage the free ends 14 of the brace members 12 in the direction opposite to the force. As the wearer brings the fin blade 10 up through the water, the resistance presses the blade 10 downward and the free end 14 of each brace member 12 is forced upward. As the wearer brings the fin blade 10 downward through the water, the resistance presses the blade 10 upward and the free end 14 of each brace member is forced downward. These forces cause one or the other of the side walls of the rotation slot 15 to press firmly against the mechanical fastener bolt or pin 50 inserted through the slot 15 into the ankle harness 30, since the free end 14 of the brace member 12 is moving at about 90 degrees to the lever line 93, while the slot line 92 is aligned at preferably from 20 to 25 degrees off the lever line, as shown in FIG. 7. Above a minimum locking threshold, the pressure is sufficient to severely restrict or preclude relative longitudinal movement between the mechanical fastener 50 and the slot 15, such that a rigid swim fin assembly results, the brace members 12 being effectively locked to the ankle harness 30, and forces are transferred directly from the blade 10 through the brace members 12 to the ankle and lower leg.

Figure 6:
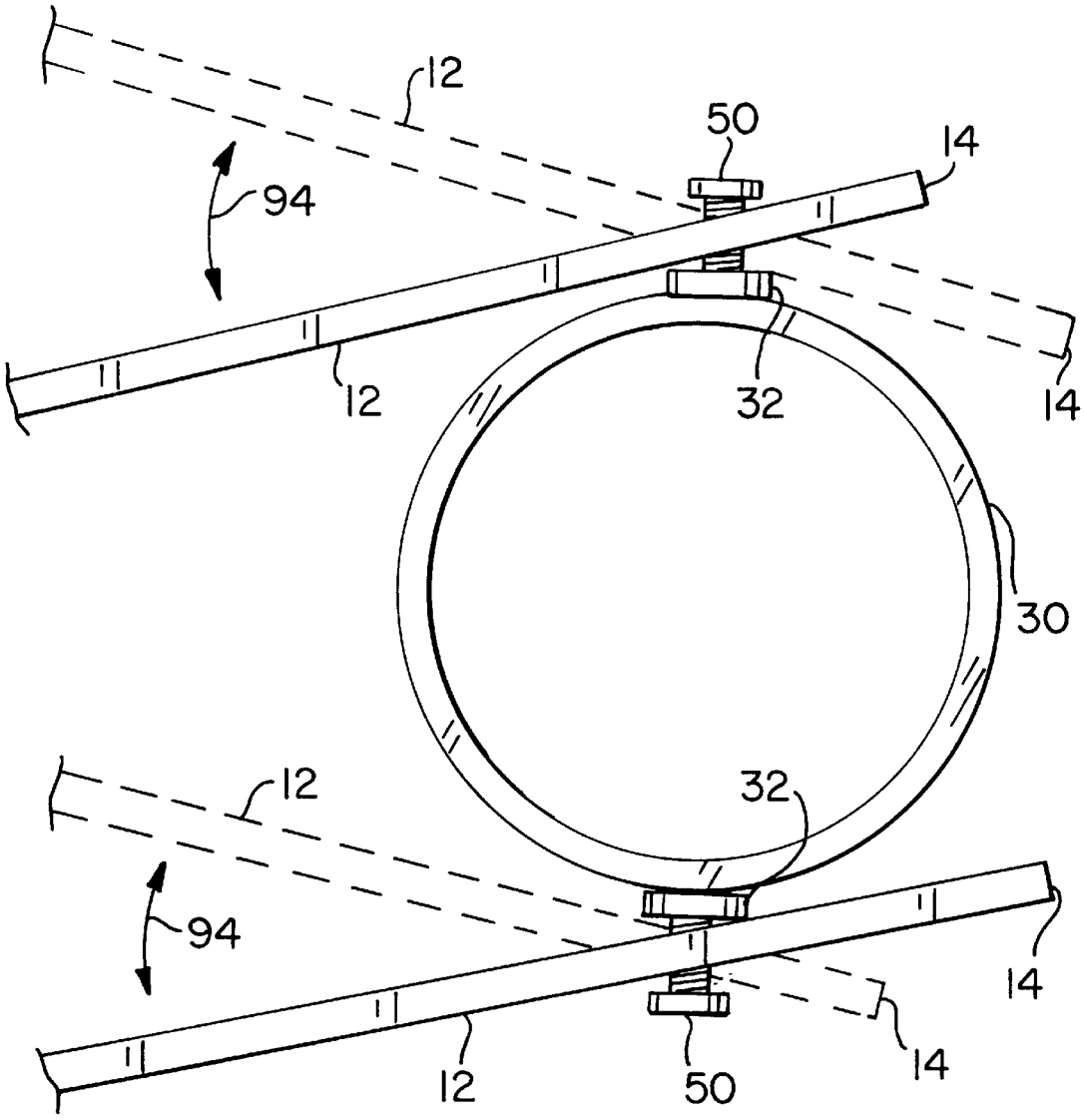
FIG. 6 is a top view showing the range of rotation of the brace members of the fin relative to the ankle harnessing means.

When the wearer is not performing the main propulsion kick, such that no or very small amounts of pressure below the minimum locking threshold are produced on the blade 10, such as when the wearer is maintaining a position in the water, the brace members 12 are not locked in rigid manner to the ankle harness 30 because the sides of the rotation slots 15 are not pressed against the mechanical fasteners 50. Since relative movement between the mechanical fasteners 50 and the slots 15 is now possible, relative movement between the foot and ankle and the foot and lower leg is also possible. The wearer can flex the foot and blade 10 by pointing and bending the foot relative to the ankle, the free ends 14 of the brace members 12 moving relative to the ankle harness 30 since the mechanical fasteners 50 are not restricted and can move to any position within the slot 15. This allows for small flutter and various other kicks in the water. The ankle rotation slots 15 also allow the wearer to rotate the foot and blade 10 about the ankle to the left or right, as shown in FIG. 6 when the braces 12 are not locked by pressure in fixed manner. The range of rotation 94 is determined by the length of the ankle rotation slots 15. Rotation of the foot to the left causes the left brace member 12 to shift rearward on the mechanical fastener 50 and the right brace member 12 to shift forward on the opposite mechanical fastener 50. Rotation of the foot to the right causes a similar shift in the opposite manner. This enables the wearer to make relatively fine adjustments to position or attitude in the water by angling or rotating the fin blades 10.

It is understood that equivalents and substitutions may be obvious to those skilled in the art to certain elements and components set forth above, and therefor the true scope and definition of the invention is to be as set forth in the following claims.

I claim:

1. A swim fin device which transfers stresses from the blade to the ankle and lower leg of the wearer by automatically locking into a rigid configuration when pressure exerted against the blade during the propulsion stroke exceeds a minimum locking threshold and which allows movement of the blade and foot relative to the ankle and lower leg when pressure exerted against the blade is below the minimum threshold, the swim fin device comprising:

(A) a generally broad, flat blade member;

(B) a pair of spaced, rigid brace members extending from said blade member, each said brace member comprising a free end, pivot means to pivotally join said brace member to a fulcrum means, and a rotation slot positioned adjacent said free end;

(C) fulcrum means connected to a foot harnessing means to provide a rigid support for leveraging movement of said brace members;

(D) foot harnessing means to connect said fulcrum means to a foot by enclosing at least a portion of the foot, said fulcrum means being positioned near the forward part of the foot and providing a rigid structure upon which said brace members pivot;

(E) ankle harnessing means to connect said free ends of said brace members to an ankle area by enclosing the ankle area, each said free end of said brace members connected through said rotation slots to said ankle harnessing means whereby limited relative movement is possible between said free ends and said ankle harnessing means unless force is applied against said blade member, in which event said brace members pivot upon said fulcrum means to lock in position said free ends to said ankle harnessing means.

2. The device of claim 1, further comprising a lever line extending through said pivot means and said rotation slot on each brace member, where said rotation slots are positioned at an angle to said lever line of approximately from 10 to 35 degrees.

3. The device of claim 2, where said rotation slots are positioned at an angle to said lever line of approximately from 20 to 25 degrees.

4. The device of claim 1, where said pivot means comprises a pivot aperture in each said brace member and said fulcrum means comprises mechanical fasteners extending through each said pivot aperture.

5. The device of claim 1, where said ankle harnessing means further comprises mechanical fasteners extending through each said rotation slot.

6. The device of claim 1, where said fulcrum means further comprises a base plate.

7. The device of claim 1, where said foot harnessing means and said ankle harnessing means comprises a boot.

8. The device of claim 1, where said foot harnessing means comprises a heel-less boot and said ankle harnessing means comprises a cuff.

9. A swim fin device comprising:

(A) foot harnessing means to attach the device to a foot;

(B) ankle harnessing means to attach the device to an ankle or lower leg area;

(C) fulcrum means connected to said foot harnessing means;

(D) a blade member having a pair of spaced, rigid brace members extending therefrom and extending and loosely connected to said ankle harnessing means, said brace members pivotally attached to said fulcrum means whereby said brace members lock in fixed relation to said ankle harnessing means when force is applied to said blade member which pivots said brace members on said fulcrum means.

10. The device of claim 9, where each said brace member further comprises pivot means to connect said brace member to said fulcrum means, a free end, a rotation slot positioned adjacent said free end, and a lever line passing through said pivot means and said rotation slot, where the angle between said rotation slot and said lever line is between approximately 20 to 25 degrees.

11. The device of claim 10, where said fulcrum means comprises a rigid structure having a pair of receptacles which each receive a mechanical fastener which extends through said pivot means in said brace members.

12. The device of claim 11, where said ankle harnessing means further comprises a pair of receptacles which each receive a mechanical fastener which extends through said rotation slots in said brace members.

13. A swim fin device comprising:

(A) a broad, generally flat, blade member having a pair of spaced apart, rigid brace members extending therefrom, each said brace member having pivot means to pivotally connect said brace member to a fulcrum means, a free end, and a rotation slot on each said free end;

(B) fulcrum means connected to a foot and to said pivot means, said fulcrum means comprising a rigid structure upon which said brace members pivot when force is applied to said blade member;

(C) ankle harnessing means comprising a member which encircles an ankle and which connects to said free ends of said brace members by mechanical fasteners extending through said rotation slots, where said rotation slots have limited movement relative to said mechanical fasteners except when force is applied to said blade member which pivots said brace members.

14. The device of claim 13, further comprising foot harnessing means to connect said fulcrum means to the foot whereby said fulcrum means is positioned near the front of the foot.

15. The device of claim 13, where each said brace members further comprises a lever line extending through said pivot means and said rotation slot, and where said rotation slot is positioned at an angle to said lever line from approximately 10 to 35 degrees.

16. The device of claim 15, where said angle is from approximately 20 to 25 degrees.

17. The device of claim 13, where said pivot means comprises a pivot aperture positioned in each brace member and said fulcrum means comprises a pari of receptacles which each receive a mechanical fastener extending through said pivot means.

* * * * *